US007250242B2

(12) United States Patent
Tachi et al.

(10) Patent No.: US 7,250,242 B2
(45) Date of Patent: Jul. 31, 2007

(54) TONER

(75) Inventors: Hidenori Tachi, Wakayama (JP); Shinji Moriyama, Wakayama (JP); Yoshihiro Fukushima, Wakayama (JP)

(73) Assignee: Kao Corporation, Tokyo (JP)

( * ) Notice: Subject to any disclaimer, the term of this patent is extended or adjusted under 35 U.S.C. 154(b) by 230 days.

(21) Appl. No.: 10/679,491

(22) Filed: Oct. 7, 2003

(65) Prior Publication Data

US 2004/0072090 A1 Apr. 15, 2004

(30) Foreign Application Priority Data

Oct. 8, 2002 (JP) ..... 2002-295116

(51) Int. Cl.
*G03G 9/09* (2006.01)

(52) U.S. Cl. ..... 430/108.6; 430/109.4; 430/111.4

(58) Field of Classification Search ..... 430/108.6, 430/108.4, 109.4, 111.4
See application file for complete search history.

(56) References Cited

U.S. PATENT DOCUMENTS 6,130,017 A 10/2000 Hayashi et al.
6,660,442 B2 * 12/2003 Sata et al. ..... 430/100
2002/0076635 A1 6/2002 Yoshino et al.

FOREIGN PATENT DOCUMENTS

| | | |
|---|---|---|
| JP | 5-281778 | 10/1993 |
| JP | 9-25126 | 1/1997 |
| JP | 2000-10344 | 1/2000 |
| JP | 2001-100451 | 4/2001 |
| JP | 2002-129063 | 5/2002 |
| JP | 2002-139866 | 5/2002 |
| JP | 2002-196528 | 7/2002 |
| JP | 2002-229259 | 8/2002 |
| JP | 2002-268281 | 9/2002 |
| JP | 2002-278144 | 9/2002 |
| JP | 2002-287545 | 10/2002 |

* cited by examiner

*Primary Examiner*—John L. Goodrow
(74) *Attorney, Agent, or Firm*—Oblon, Spivak, McClelland, Maier & Neustadt, P.C.

(57) ABSTRACT

A toner comprising a resin binder and a colorant comprising a composite oxide of two or more metals, wherein the composite oxide has a BET specific surface area of 0.5 to 7 $m^2/g$ and a saturation magnetization of from 1 to 40 $Am^2/kg$; and a two-component developer comprising the above toner and a carrier having a saturation magnetization of from 40 to 100 $Am^2/kg$. The toner can be used for the development of a latent image formed in electrophotography, electrostatic recording method, electrostatic printing method or the like.

9 Claims, No Drawings

TONER

FIELD OF THE INVENTION

The present invention relates to a toner used for the development of a latent image formed in electrophotography, electrostatic recording method, electrostatic printing method or the like.

BACKGROUND OF THE INVENTION

With the advancement of on-demand printing, there has been earnestly desired to develop a toner and a developer which can meet the requirements of both high speed and high-quality image. Especially in a high-speed machine, an excellent fixing ability is required because the heat conduction time is short. Recently, there has been also necessity to carry out label printing or printing on a thick paper such as a hard cover of a book. From these viewpoints, improvement in the fixing ability of a toner has been also an important problem to be solved.

On the other hand, from the viewpoint of obtaining high-quality image, there has been proposed the use of a composite oxide as a black colorant as a substitute material for a carbon black having a low resistance (see Japanese Patent Laid-Open No. 2000-10344 (corresponding to U.S. Pat. No. 6,130,017), Japanese Patent Laid-Open No. Hei 9-25126, Japanese Patent Laid-Open No. 2002-196528 (corresponding to U.S. Publication No. 2002076635), and the like). However, when a toner comprising a composite oxide is used in a printing device with linear speed exceeding 370 mm/sec, or used for printing on a thick paper having a basis weight exceeding 80 g/m$^2$, fixing failure is generated.

An object of the present invention is to provide a toner which has an excellent fixing ability and gives high-quality fixed images, even when the toner is fixed with a high-speed machine, or fixed on a thick paper.

These and other objects of the present invention will be apparent from the following description.

SUMMARY OF THE INVENTION

The present invention relates to:

(1) a toner comprising:
  a resin binder and
  a colorant comprising a composite oxide of two or more metals, wherein the composite oxide has a BET specific surface area of 0.5 to 7 m$^2$/g and a saturation magnetization of from 1 to 40 Am$^2$/kg;

(2) a two-component developer comprising the toner as defined in the above (1) and a carrier having a saturation magnetization of from 40 to 100 Am$^2$/kg; and (3) a method for fixing a toner comprising the step of fixing the toner as defined in the above (1) on a paper having a basis weight of 60 to 150 g/m$^2$.

DETAILED DESCRIPTION OF THE INVENTION

One of the features of the toner of the present invention resides in that the toner comprises a colorant comprising a composite oxide having a specified BET specific surface area and a specified saturation magnetization. Since the composite oxide causes a crosslinking reaction with a resin binder, when the dispersibility of the composite oxide in the resin binder is increased, the metal-crosslinking between the composite oxide and the resin binder is progressed, thereby worsening the fixing ability. However, in the present invention, since the BET specific surface area and the saturation magnetization of the composite oxide are adjusted, the dispersibility of the composite oxide is increased, with suppressing the degree of metal-crosslinking causative of the fixing ability deterioration, thereby improving the fixing ability of the toner.

The composite oxide has a BET specific surface area of from 0.5 to 7 m$^2$/g, preferably from 2 to 6.9 m$^2$/g, more preferably from 5 to 6.8 m$^2$/g. In the present invention, in order to decrease the BET specific surface area, it is preferable that the composite oxide is spherical.

On the other hand, the composite oxide has a saturation magnetization of from 1 to 40 Am$^2$/kg, preferably from 1.5 to 40 Am$^2$/kg, more preferably from 4 to 35 Am$^2$/kg, still more preferably from 10 to 35 Am$^2$/kg, especially preferably from 15 to 30 Am$^2$/kg. The saturation magnetization of the composite oxide can be controlled to a desired value by adjusting the ratios of constituting metals. For instance, in a composite oxide having a hematite structure, the saturation magnetization can be easily controlled by adjusting the ratio of iron to other metal. In this case, the higher the ratio of iron, the higher the saturation magnetization.

It is necessary that the composite oxide in the present invention is constituted by at least 2 metals, from the viewpoint of the triboelectric chargeability of the toner. The metal constituting the composite oxide includes those belonging to Groups 2 to 12 of the Third Period or the Fourth Period of the Periodic Table, and the like. It is preferable from the viewpoint of controlling the degree of blackness of the toner, the image property and the magnetic property that the two or more metals are Fe (iron), and at least one selected from the group consisting of Ti (titanium) and Mg (magnesium). The compositional ratio of iron to at least one of titanium and magnesium (weight ratio of Fe/M, wherein M is a total content of Ti and Mg) is preferably from 0.8 to 10, more preferably from 1 to 8, especially preferably from 1.5 to 7. In addition, although other metals other than the above compounds may be contained in the composite oxide in the present invention, the total amount of iron, titanium and magnesium is contained in an amount of preferably 20% by weight or more, preferably 30% by weight or more, more preferably 40% by weight or more in the composite oxide, from the viewpoints of the fixing ability, the chargeability and the degree of blackness of the toner. The compositional ratio of the metals other than the above to the total amount of iron, titanium and magnesium in the composite oxide is not particularly limited.

The process for preparing a composite oxide includes a process comprising depositing other oxide on a surface of the main oxide used as a core particle (Japanese Patent Laid-Open No. 2000-10344), a process of making a composite oxide comprising sintering several oxides (Japanese Patent Laid-Open No. Hei 9-25126), and the like, without being particularly limited thereto.

The composite oxide has an average particle size of preferably from 2 to 1000 nm, more preferably from 5 to 500 nm, especially preferably from 5 to 200 nm, from the viewpoint of the dispersibility of the resin binder.

Preferable commercially available composite oxide in the present invention includes "K-004" and "K-017" (hereinabove commercially available from Toda Kogyo Corp.), and the like.

The content of the composite oxide is preferably from 1 to 40% by weight, more preferably from 2.5 to 30% by weight, especially preferably from 4 to 25% by weight, of the toner, from the viewpoints of the degree of blackness and the triboelectric chargeability of the toner.

In the present invention, two or more kinds of composite oxides may be used together. In this case, those individual composite oxides are allowed to have a BET specific surface area and a saturation magnetization outside the ranges specified in the present invention as long as the composite oxide as a whole has a BET specific surface area and a saturation magnetization within the ranges specified above.

Incidentally, the toner of the present invention may appropriately contain a known colorant other than the above-described composite oxide as a colorant. However, it is preferable that a carbon black is not contained from the viewpoint of the resistance control.

The resin binder in the present invention includes polyesters, resin mixtures of polyester/styrene-acrylic resin, styrene-acrylic resins, hybrid resins in which two or more resin components are partially chemically bonded to each other, and the like. From the viewpoints of the low-temperature fixing ability, the durability and the dispersibility of the materials, it is preferable that the resin binder comprises a polyester as a main component. The content of the polyester is preferably from 50 to 100% by weight, more preferably from 70 to 100% by weight, of the resin binder. The amount of the resin binder contained in the toner is preferably from 60 to 99% by weight, more preferably from 70 to 97.5% by weight, still more preferably from 75 to 96% by weight, from the viewpoints of suppression of the metal-crosslinking by the composite oxide and the fixing ability or the like.

The raw material monomer for the polyester in the present invention is not particularly limited, and known alcohol components and known carboxylic acid components such as carboxylic acids, and carboxylic acid anhydrides or esters thereof, are used.

It is preferable that the alcohol component contains a compound represented by the formula (I):

(I)

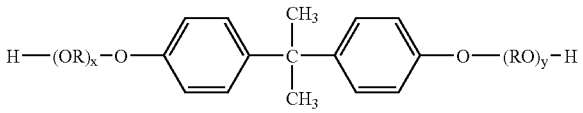

wherein R is an alkylene group having 2 or 3 carbon atoms; each of x and y is a positive number, wherein a sum of x and y is from 1 to 16, preferably from 1.5 to 5.0.

The compound represented by the formula (I) includes alkylene(2 to 3 carbon atoms) oxide(average number of moles: 1 to 16) adducts of bisphenol A such as polyoxypropylene(2.2)-2,2-bis(4-hydroxyphenyl)propane and polyoxyethylene(2.2)-2,2-bis(4-hydroxyphenyl)propane, and the like. In addition, other alcohol component includes ethylene glycol, propylene glycol, glycerol, pentaerythritol, trimethylolpropane, hydrogenated bisphenol A, sorbitol, alkylene(2 to 4 carbon atoms) oxide(average number of moles: 1 to 16) adducts thereof, and the like.

It is desired that the content of the compound represented by the formula (I) is 5% by mol or more, preferably 50% by mol or more, more preferably 100% by mol, of the alcohol component.

In addition, the carboxylic acid component includes dicarboxylic acids such as phthalic acid, isophthalic acid, terephthalic acid, fumaric acid, maleic acid, adipic acid, and succinic acid; a substituted succinic acid of which substituent is an alkyl group having 1 to 20 carbon atoms or an alkenyl group having 2 to 20 carbon atoms, such as dodecenylsuccinic acid and octenylsuccinic acid; tricarboxylic or higher polycarboxylic acids such as trimellitic acid and pyromellitic acid; acid anhydrides thereof; alkyl(1 to 8 carbon atoms) esters thereof; and the like.

The polyester can be prepared by, for instance, polycondensation of an alcohol component with a carboxylic acid component at a temperature of 180° to 250° C. in an inert gas atmosphere in the presence of an esterification catalyst as desired.

The polyester has an acid value of preferably from 0.5 to 60 mg KOH/g. In particular, from the viewpoint of suppressing the metal-crosslinking, the acid value is more preferably 20 mg KOH/g or less, still more preferably 15 mg KOH/g or less. The polyester has a hydroxyl value of preferably from 1 to 60 mg KOH/g.

Also, it is preferable that the polyester has a softening point of 80° to 165° C. and a glass transition point of 50° to 85° C.

Further, it is preferable that the toner of the present invention contains a releasing agent. As the releasing agent, known releasing agents such as polypropylene waxes can be used. The releasing agent is preferably at least one member selected from the group consisting of camauba wax, montan wax, candelilla wax and rice wax, from the viewpoint of the fixing ability, and camauba wax is more preferable.

The melting point of the releasing agent is preferably from 70° to 90° C. from the viewpoint of the low-temperature fixing ability.

The content of the releasing agent is preferably from 0.1 to 8 parts by weight, more preferably from 0.5 to 5 parts by weight, especially preferably from 1 to 3 parts by weight, based on 100 parts by weight of the resin binder, from the viewpoints of the triboelectric chargeability, the fixing ability and the durability.

Further, the toner of the present invention may appropriately contain an additive such as a charge control agent, a fluidity improver, an electric conductivity modifier, an extender, a reinforcing filler such as a fibrous substance, an antioxidant, an anti-aging agent, and a cleanability improver.

The toner of the present invention is preferably a pulverized toner obtained by kneading and pulverization method. Specifically, the toner can be prepared by homogeneously mixing raw materials such as a resin binder, a colorant and a releasing agent in a mixer such as a Henschel mixer, thereafter melt-kneading with a closed kneader, a single-screw or twin-screw extruder, or the like, cooling, pulverizing, and classifying the product. The toner has a volume-average particle size of preferably from 3 to 15 μm, more preferably from 5 to 12 μm. Further, an external additive such as a fluidity improver may be added to the surface of the toner.

The toner of the present invention can be used as a nonmagnetic monocomponent developer, or the toner can be mixed with a carrier to be used as a two-component developer.

When the toner of the present invention is used as a two-component developer, the carrier used is preferably one having a low saturation magnetization, which forms a soft magnetic brush, from the viewpoint of the image properties. The saturation magnetization of the carrier is preferably from 40 to 100 $Am^2/kg$, more preferably from 50 to 90 $Am^2/kg$. The saturation magnetization is preferably 100 $Am^2/kg$ or less from the viewpoints of controlling the hardness of the magnetic brush and retaining the tone reproducibility, and preferably 40 $Am^2/kg$ or more from the viewpoint of preventing the carrier adhesion and the toner scattering.

As a core material for the carrier, any core of a known material can be used without any particular limitation. The core material includes, for instance, ferromagnetic metals such as iron, cobalt and nickel; alloys and compounds such as magnetite, hematite, ferrite, copper-zinc-magnesium-based ferrite and manganese-based ferrite; glass beads; and the like. Among them, powdery iron, magnetite, ferrite, copper-zinc-magnesium-based ferrite and manganese-based ferrite are preferable.

It is preferable that the surface of the carrier is coated with a resin from the viewpoint of reducing the carrier contamination. The resin for coating the surface of the carrier varies with the materials for the toner, and includes, for instance, fluororesins such as polytetrafluoroethylenes, monochlorotrifluoroethylene polymers and poly(vinylidene fluorides); silicone resins such as dimethylsilicone; polyester resins, styrenic resins, acrylic resins, polyamides, polyvinyl butyrals, aminoacrylate resins, and the like. These resins can be used alone or in admixture of two or more kinds. In the case where the toner is positively chargeable, fluororesins and silicone resins are preferable from the viewpoints of the triboelectric chargeability and the surface energy.

The method for coating the core material with the resin is not particularly limited, and includes, for instance, a method comprising dissolving or suspending a coating material such as a resin in a solvent, applying the resulting solution to a core material, and adhering the coating material to the core material; a method comprising simply blending the resin with a core material in powdery forms; and the like.

In the two-component developer prepared by mixing a toner and a carrier, the weight ratio of the toner to the carrier (toner/carrier) is preferably from 0.5/100 to 8/100, more preferably from 1/100 to 6/100.

The toner of the present invention can be also suitably used in a printing device with a linear speed of 370 mm/sec or more, preferably 500 mm/sec or more and 2000 mm/sec or less because the toner has a highly excellent fixing ability. Here, the linear speed refers to a processing speed of a printing device, and is determined by sheet feeding speed in the fixing device.

Since the toner of the present invention has a highly excellent fixing ability, the toner is preferably suitably used for printing on a paper having a basis weight from 60 to 150 $g/m^2$, so that the fixing failure is prevented even when printed on a thick paper. Therefore, especially, the toner of the present invention can be also suitably used for printing on a thick paper having a basis weight exceeding 80 $g/m^2$, for instance, a thick paper having a basis weight of 90 $g/m^2$ or 115 $g/m^2$.

Furthermore, there is provided a method for fixing a toner comprising the step of fixing the toner according to the present invention on a paper having a basis weight of 60 to 150 $g/m^2$.

EXAMPLES

[Softening Point]

The softening point is determined by a method according to ASTM D36-86.

[Acid Value and Hydroxyl Value]

The acid value and the hydroxyl value are measured by a method according to JIS K 0070.

[Glass Transition Point and Melting Point]

The glass transition point and the melting point are determined using a differential scanning calorimeter "DSC 210" (commercially available from Seiko Instruments, Inc.) with raising the temperature at a rate of 10° C./min.

[BET Specific Surface Area]

The BET specific surface area is determined by the nitrogen adsorption method.

[Saturation Magnetization]

(1) A sample is filled in a plastic case with a lid with tapping, the case having an outer diameter of 7 mm and a height of 5 mm. The mass of the sample is determined from the difference of the weight of the plastic case and the weight of the plastic case filled with the sample.

(2) The plastic case filled with the sample is set in a sample holder of a device for measuring magnetic property "BHV-50H" (V. S. MAGNETOMETER) commercially available from Riken Denshi Co., Ltd. The saturation magnetization is determined by applying a magnetic field of 79.6 kA/m, with vibrating the plastic case using the vibration function. The value obtained is calculated as the saturation magnetization per unit mass, taking into consideration the mass of the filled sample.

Resin Preparation Example 1

The amount 735 g of polyoxypropylene(2.2)-2,2-bis(4-hydroxyphenyl)propane, 293 g of polyoxyethylene(2.2)-2,2-bis(4-hydroxyphenyl)propane, 280 g of isophthalic acid, 60 g of isooctenylsuccinic acid, 72 g of 1,2,4-benzenetricarboxylic acid and 2 g of dibutyltin oxide were placed in a 3-liter four-necked glass flask equipped with a thermometer, a stainless stirrer, a reflux condenser and a nitrogen inlet tube. The contents in the flask were reacted at 230° C. under nitrogen gas stream in an electric mantle under vacuum with stirring. The polymerization degree was monitored by the softening point, and the reaction was terminated when the softening point reached 136° C., to give a resin A. The resin A was a pale yellow solid and had a glass transition point of 63° C., an acid value of 3.1 mg KOH/g and a hydroxyl value of 35.2 mg KOH/g.

Resin Preparation Example 2

The amount 900 g of polyoxypropylene(2.2)-2,2-bis(4-hydroxyphenyl)propane, 250 g of neopentyl glycol, 580 g of terephthalic acid, 130 g of trimellitic anhydride and 2 g of dibutyltin oxide were placed in a 2-liter four-necked glass flask equipped with a thermometer, a stainless stirrer, a reflux condenser and a nitrogen inlet tube. The contents in the flask were heated to a temperature of from 180° to 230° C. under nitrogen gas stream in an electric mantle over 8 hours, and then reacted under vacuum with stirring. The polymerization degree was monitored by the acid value, and the reaction was terminated when the acid value reached 10.2 mg KOH/g, to give a resin B. The resin B was a pale yellow solid and had a glass transition point of 66° C., a softening point of 145° C., an acid value of 10.2 mg KOH/g and a hydroxyl value of 45.2 mg KOH/g.

Resin Preparation Example 3

Five hundred and fifty grams of xylene was placed in a 5-liter four-necked glass flask equipped with a thermometer, a stainless stirrer, a reflux condenser and a nitrogen inlet tube, and heated to 135° C. after introducing nitrogen. Eight hundred grams of styrene and 300 g of n-butyl acrylate as monomers for a styrenic resin, and 26 g of dicumyl peroxide as a polymerization initiator were placed in a dropping funnel, and added dropwise to the xylene over 1 hour, and the mixture was aged for 2 hours to 135° C. Thereafter, the mixture was heated to 200° C., and xylene was removed under reduced pressure. The resulting product was taken out on a vat, cooled, and then pulverized, to give a resin C. The resin C had a softening point of 138° C., and a glass transition point of 65° C.

Examples 1 to 5 and Comparative Examples 1 to 6

The amount 100 parts by weight of a resin binder, 10 parts by weight of a colorant and 1 part by weight of a releasing agent, as shown in Table 1, and 1.5 parts by weight of a positively chargeable charge control agent "BONTRON N-01" (commercially available from Orient Chemical Co., Ltd.) were premixed with a Henschel mixer. Thereafter, the mixture was melt-kneaded with a twin-screw extruder, cooled, and thereafter subjected to usual pulverization step and classification step, to give a powder. To the surface of 100 parts by weight of the resulting powder were added 0.3 parts by weight of a hydrophobic silica hydrophobically treated with an amino-modified polysiloxane, "HVK 2150" (commercially available from Clariant (Japan) K.K.). The ingredients were mixed with a Henschel mixer to adhere the silica to the powder, to give a toner having a volume-average particle size of 10 μm. The softening points of the toners are shown in Table 1.

TABLE 1

| | Resin | Colorant | Releasing Agent* | Softening Point (° C.) |
|---|---|---|---|---|
| Ex. 1 | Resin C | K-004 | NP-055 | 127 |
| Ex. 2 | Resin B | K-004 | NP-055 | 126 |
| Ex. 3 | Resin A | K-004 | NP-055 | 127 |
| Ex. 4 | Resin A | K-004 | Carnauba Wax C1 | 125 |
| Ex. 5 | Resin A | K-017 | Carnauba Wax C1 | 125 |
| Comp. Ex. 1 | Resin A | Dye Pyroxide Black No. 2 | NP-055 | 131 |
| Comp. Ex. 2 | Resin A | HSB-603 | NP-055 | 132 |
| Comp. Ex. 3 | Resin A | HSB-605 | NP-055 | 132 |
| Comp. Ex. 4 | Resin A | ETB-200 | NP-055 | 138 |
| Comp. Ex. 5 | Resin A | MTS-304 | NP-055 | 138 |
| Comp. Ex. 6 | Resin A | R330R | NP-055 | 126 |

*NP-055: polypropylene wax, commercially available from MITSUI CHEMICALS, INC.
Carnauba Wax C1: commercially available from K.K. Kato Yoko, Incidentally, the BET specific surface areas, the saturation magnetizations and the like of the colorants used in Examples and Comparative Examples are shown in Table 2. The total content of iron, titanium and magnesium in the colorant used in Examples are all 20% by weight or more.

TABLE 2

| Colorant | BET Specific Surface Area ($m^2/g$) | Saturation Magnetization ($Am^2/kg$) | Major Metals Contained |
|---|---|---|---|
| K-004 (commercially available from Toda Kogyo Corp.) | 6.8 | 4.5 | Fe, Ti |
| K-017 (commercially available from Toda Kogyo Corp.) | 6.5 | 24.8 | Fe, Ti |
| Dye Pyroxide Black No. 2 (commercially available from DAINICHISEIKA COLOR & CHEMICALS MFG. CO., LTD.) | 56.0 | 9.0 | Fe, Mn, Cu |
| HSB-603 (commercially available from Toda Kogyo Corp.) | 2.8 | 0.2 | Fe, Mn |
| HSB-605 (commercially available from Toda Kogyo Corp.) | 6.0 | 0.3 | Fe, Mn |
| ETB-200 (commercially available from Titan Kogyo K.K.) | 7.2 | 1.1 | Fe, Ti |
| MTS-304 (commercially available from Toda Kogyo Corp.) | 6.1 | 85.0 | $Fe_3O_4$ |
| R 330 R (commercially available from Cabot Corporation) | 94.0 | 0.0 | Carbon Black |

Test Example 1

Thirty-nine parts by weight of a toner and 1261 parts by weight of a fluororesin/acrylic resin-coated magnesium-based ferrite carrier having a saturation magnetization of 60 $Am^2/kg$ (average particle size: 100 μm) were mixed with a Nauta Mixer, to give each two-component developer.

The two-component developer was loaded in a contact two-component development device "Infoprint 4000 IS1" (commercially available from IBM Japan, Ltd., linear speed: 1066 mm/sec, resolution: 240 dpi, development system: 3 magnet rollers and selenium photoconductor, reversal development). Ten print patterns with a printing ratio of 15% were continuously printed using continuous feeding paper having different basis weights (11×18 inches).

A sand-rubber eraser (trade name: "ERASER 512 SAND-RUBBER ERASER FOR TYPEWRITER," product number: keshi-21, commercially available from KOKUYO Co., Ltd.) to which a load of 500 g was applied, the eraser having a bottom area of 15 mm×7.5 mm, was moved backward and forward seven times over each of the 10 fixed images obtained. The optical reflective density of the image before or after the eraser treatment was measured with a GRETAG SPM 50 (commercially available from GretagMacbeth AG). The reduction ratio of the image density was determined according to the following equation. The fixing ability was evaluated according to the evaluation criteria given below, on the basis of an average of the reduction ratios of image densities of 10 fixed images. The results are shown in Table 3.

$$\text{Reduction Ratio of Image Density (\%)} = \left(1 - \frac{\text{Density After Eraser Treatment}}{\text{Density Before Eraser Treatment}}\right) \times 100$$

[Evaluation Criteria]

A: The average of the reduction ratios of image density is less than 10%;

B: The average of the reduction ratios of image density is 10% or more and less than 20%;

C: The average of the reduction ratios of image density is 20% or more and less than 30%; and D: The average of the reduction ratios of image density is 30% or more.

TABLE 3

| | Composite Oxide | | | | | |
|---|---|---|---|---|---|---|
| | BET Specific Surface Area | Saturation Magnetization | Kind of Paper (Basis Weight: g/m$^2$) | | | |
| | (m$^2$/g) | (Am$^2$/kg) | 65 | 90 | 115 | 140 |
| Ex. 1 | 6.8 | 4.5 | A | B | C | C |
| Ex. 2 | 6.8 | 4.5 | A | B | B | C |
| Ex. 3 | 6.8 | 4.5 | A | A | B | B |
| Ex. 4 | 6.8 | 4.5 | A | A | A | B |
| Ex. 5 | 6.5 | 24.8 | A | A | A | A |
| Comp. Ex. 1 | 56.0 | 9.0 | B | C | D | D |
| Comp. Ex. 2 | 2.8 | 0.2 | A | B | C | D |
| Comp. Ex. 3 | 6.0 | 0.3 | A | B | C | D |
| Comp. Ex. 4 | 7.2 | 1.1 | B | B | D | D |
| Comp. Ex. 5 | 6.1 | 85.0 | B | D | D | D |
| Comp. Ex. 6 | 94.0 | 0.0 | B | C | C | D |

From the results in Table 3, the toners comprising a composite oxide specified in the present invention exhibit excellent fixing ability even when printed on a paper having a large basis weight. This is presumably due to the fact that the metal-crosslinking is suppressed, so that the softening point is not increased, as shown in Table 1, and the dispersibility is also improved in Examples, though the toners of Examples comprise a composite oxide. Especially, in Examples 4 and 5 in which a polyester is used as a resin binder and carnauba wax is used as a releasing agent, remarkably excellent results were obtained.

On the other hand, in Comparative Examples 1 to 5, since the toners comprise a composite oxide having a BET specific surface area or a saturation magnetization outside the ranges defined in the present invention, the fixing ability is worsened. This is presumably because the softening point of toner is increased due to the metal-crosslinking, or dispersion failure of the composite oxide is caused due to lack of balance in the BET specific surface area and the saturation magnetization. This is supported by the fact that the fixing ability of the toner of Comparative Example 1 or Comparative Example 5, which comprises a composite oxide having a BET specific surface area or a saturation magnetization far outside the range defined in the present invention, is extremely poor. Further, in Comparative Example 6, though increase in the softening point due to the metal-crosslinking is not observed, since a carbon black is used, sufficient fixing ability is not secured due to dispersion failure of the carbon black.

The toner of the present invention exhibits an excellent effect that the toner has an excellent fixing ability and gives high-quality fixed images, even when the toner is fixed with a high-speed machine, or fixed on a thick paper.

What is claimed is:

1. A toner comprising:

a resin binder a colorant comprising a composite oxide of two or more metals, wherein the composite oxide has a BET specific surface area of 0.5 to 7 m$^2$/g and a saturation magnetization of from 1.5 to 40 Am$^2$/kg.

2. The toner according to claim 1, wherein the metal constituting the composite oxide is Fe (iron) and at least one member selected from the group consisting of Ti (titanium) and Mg (magnesium).

3. The toner according to claim 1, wherein the composite oxide is contained in the toner in an amount of from 1 to 40% by weight.

4. The toner according to claim 1, wherein the resin binder comprises a polyester as a main component.

5. The toner according to claim 1, further comprising at least one releasing agent selected form the group consisting of carnauba wax, montan wax, candelilla wax and rice wax.

6. The toner according to claim 1, wherein the toner has a volume-average particle size of from 3 to 15 μm.

7. The toner according to claim 1, wherein the toner is loaded on a printing device with a linear speed of 370 mm/sec or more.

8. A two-component developer comprising the toner as defined in claim 1 and a carrier having a saturation magnetization of from 40 to 100 Am$^2$/kg.

9. A method for fixing a toner comprising the step of fixing the toner as defined in claim 1 on a paper having a basis weight of 60 to 150 g/m$^2$.

* * * * *